US010619414B2

(12) United States Patent
Ng et al.

(10) Patent No.: US 10,619,414 B2
(45) Date of Patent: Apr. 14, 2020

(54) PIVOT MOUNT FOR ROLLER SHADE

(71) Applicant: ZMC Metal Coating Inc., Woodridge, Ontario (CA)

(72) Inventors: Philip Ng, Thornhill (CA); Norman Wills, Mississauga (CA)

(73) Assignee: ZMC METAL COATING INC., Woodbridge (CA)

( * ) Notice: Subject to any disclaimer, the term of this patent is extended or adjusted under 35 U.S.C. 154(b) by 371 days.

(21) Appl. No.: 15/505,227

(22) PCT Filed: Jun. 26, 2015

(86) PCT No.: PCT/CA2015/050603

§ 371 (c)(1),
(2) Date: Feb. 20, 2017

(87) PCT Pub. No.: WO2016/026033

PCT Pub. Date: Feb. 25, 2016

(65) Prior Publication Data

US 2017/0247943 A1 Aug. 31, 2017

Related U.S. Application Data

(60) Provisional application No. 62/040,566, filed on Aug. 22, 2014.

(51) Int. Cl.

| | |
|---|---|
| ***E06B 9/72*** | (2006.01) |
| ***E06B 9/42*** | (2006.01) |
| ***E06B 9/50*** | (2006.01) |

(52) U.S. Cl.

CPC ..... *E06B 9/42* (2013.01); *E06B 9/50* (2013.01); *E06B 9/72* (2013.01)

(58) Field of Classification Search

CPC ..... E06B 9/42; E06B 9/50; E06B 9/72; Y10T 24/44017; Y10T 24/45775; A47H 1/16; A47H 1/13; F16B 21/18; F16B 21/186

(Continued)

(56) References Cited

U.S. PATENT DOCUMENTS 3,551,963 A * 1/1971 Mosher, Jr. et al. ..... A44B 17/0029 24/618

5,538,066 A 7/1996 Liu (Continued)

FOREIGN PATENT DOCUMENTS

GB 190323123 A 8/1904
GB 619170 A 3/1949

OTHER PUBLICATIONS

International Search Report and Written Opinion dated Aug. 27, 2015 for corresponding PCT Application No. PCT/CA2015/050603.

(Continued)

*Primary Examiner* — Katherine W Mitchell
*Assistant Examiner* — Jeremy C Ramsey
(74) *Attorney, Agent, or Firm* — Kinney & Lange, P.A.

(57) ABSTRACT

A mount for a roller blind. The roller blind has a roller tube securable to a structure between first and second end brackets. In one embodiment the mount comprises at least one yoke and at least one axle member. The yoke is securable to the first end bracket and has a generally horizontally oriented throat. The axle member is releasably securable to a first end of the roller tube with at least a portion retainable within the yoke's throat when the axle member is generally horizontal. The receipt of the said axle member within the throat hangs the first end of the roller tube from the first end bracket while permitting the roller tube to pivot about the first end bracket in a generally vertical plane.

5 Claims, 17 Drawing Sheets

(58) Field of Classification Search
USPC ..... 248/266, 302, 267, 268
See application file for complete search history.

(56) References Cited

U.S. PATENT DOCUMENTS

| | | | | |
|---|---|---|---|---|
| 9,845,908 | B2 * | 12/2017 | Brunella | F16L 37/144 |
| 2006/0021715 | A1 | 2/2006 | Nien | |
| 2011/0297633 | A1 * | 12/2011 | Lin | E06B 9/44<br>211/123 |
| 2013/0318755 | A1 * | 12/2013 | Chawla | F16B 21/186<br>24/662 |
| 2015/0083351 | A1 * | 3/2015 | Campagna | E06B 9/50<br>160/310 |
| 2015/0240980 | A1 * | 8/2015 | Bobo | F16L 37/0915<br>285/321 |
| 2015/0300085 | A1 * | 10/2015 | Klein Tuente | A47H 1/142<br>248/267 |
| 2017/0204659 | A1 * | 7/2017 | Marcinik | E06B 9/50 |

OTHER PUBLICATIONS

International Preliminary Report on Patentability, for PCT Patent Application No. PCT/CA2015/050603, dated Feb. 28, 2017, 5 pages.

* cited by examiner

PIVOT MOUNT FOR ROLLER SHADE

FIELD

This invention relates generally to the field of brackets used to mount roller shades and other similar types of window coverings within a window or opening, or to a surface, and in particular to a new and unique pivot mount for a roller shade.

BACKGROUND

Roller shades, or blinds as they are sometimes referred to, are common forms of window coverings used in residential and commercial applications. Roller shades are typically mounted within or exterior to a window frame by means of mounting brackets that are screwed or otherwise fastened to structural elements of the window frame or the wall and/or ceiling adjacent to the window frame. It is in most cases desirable to mount the brackets such that the roller shade is positioned as close as possible (or practical) to the window frame, the wall and/or the ceiling in order to minimize the amount of light infiltration or leakage into the room. However, care must also be taken to provide sufficient spacing between the roller and the window to permit the blind fabric to be wound or unwound upon the roller tube without binding upon either the wall, ceiling, window frame or glass.

Typically, the roller tube upon which the blind or shade fabric is received has one end that is generally referred to as the idler end and a second or drive end that cooperates or otherwise is engaged by some form of drive mechanism. The idler end will commonly include an axle or bearing structure that supports the end of the roller tube, while still allowing it to rotate about its longitudinal axis. The drive end will typically be engaged by a clutch that is rotated by a drive mechanism to permit a controlled rotation of the roller tube and to enable the blind to be either raised or lowered. The drive mechanism may involve a chain or cord which can be pulled to rotate the roller tube. However, increasingly it is becoming common to impart rotational movement to the roller tube through the use of an electric motor.

The roller tube and the other components of the shade or blind are most commonly mounted in place about a window using a pair of end brackets. During installation the end brackets are fastened to the window frame, wall or ceiling, after which the roller rube is secured or hung from the two brackets. While installing the brackets in many instances does not present difficulty, securing the roller tube to the end brackets can at times be tedious, particularly in cases where the roller tube is of an extended length or significant weight (for example, where the tube includes an electric motor). In such cases an installer must often struggle with attempting to hold the roller tube with one hand while securing it within one of the end brackets using the other hand, or resort to employing the assistance of an additional individual to hold one end of the tube while the other end is secured to one of the end brackets. In either case, installation of the blind can become difficult, or can involve an increase in labour costs.

SUMMARY

The invention therefore provides a pivot mount for roller shade that helps to address some of the deficiencies in the prior art.

Accordingly, in one of its aspects the invention provides a pivot mount for a roller blind, the roller blind having a roller tube for the receipt of blind fabric thereon, the roller tube releasably securable to a structure between first and second end brackets, the pivot mount comprising at least one yoke securable to the first end bracket, said yoke having a generally horizontally oriented throat, and at least one axle member, said axle member releasably securable to a first end of the roller tube, at least a portion of said axle member retainable within said throat of said yoke when said axle member is generally horizontal, receipt of at least a portion of said axle member within said throat hanging the first end of the roller tube from the first end bracket while permitting the roller tube to pivot about the first end bracket in a generally vertical plane.

In a further aspect the invention provides a pivot mount for a roller bind, the roller blind having a roller tube for the receipt of blind fabric thereon, the roller tube having first and second ends that are releasably securable to first and second end brackets, the first and second end brackets being releasably securable to a structure to enable the blind to be mounted thereon, the blind having a roller tube motor received in the first end of the roller tube with an end of the motor exposed, the pivot mount comprising a pair of yokes secured to the first end bracket, said yokes generally horizontally oriented and having generally horizontally oriented throats; and an axle member releasably securable to the exposed end of the roller tube motor, said axle member comprising a roller tube bracket having a pair of spindles extending from opposite sides thereof, at least a portion of said spindles retainable within said throats of said yokes when said axle member is generally horizontal, receipt of at least a portion of said spindles within said throats hanging the first end of the roller tube from the first end bracket while permitting the roller tube to pivot about the first end bracket in a generally vertical plane.

Further aspects of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

The present invention may be embodied in a number of different forms. The specification and drawings that follow describe and disclose some of the specific forms of the invention.

Figure 1:
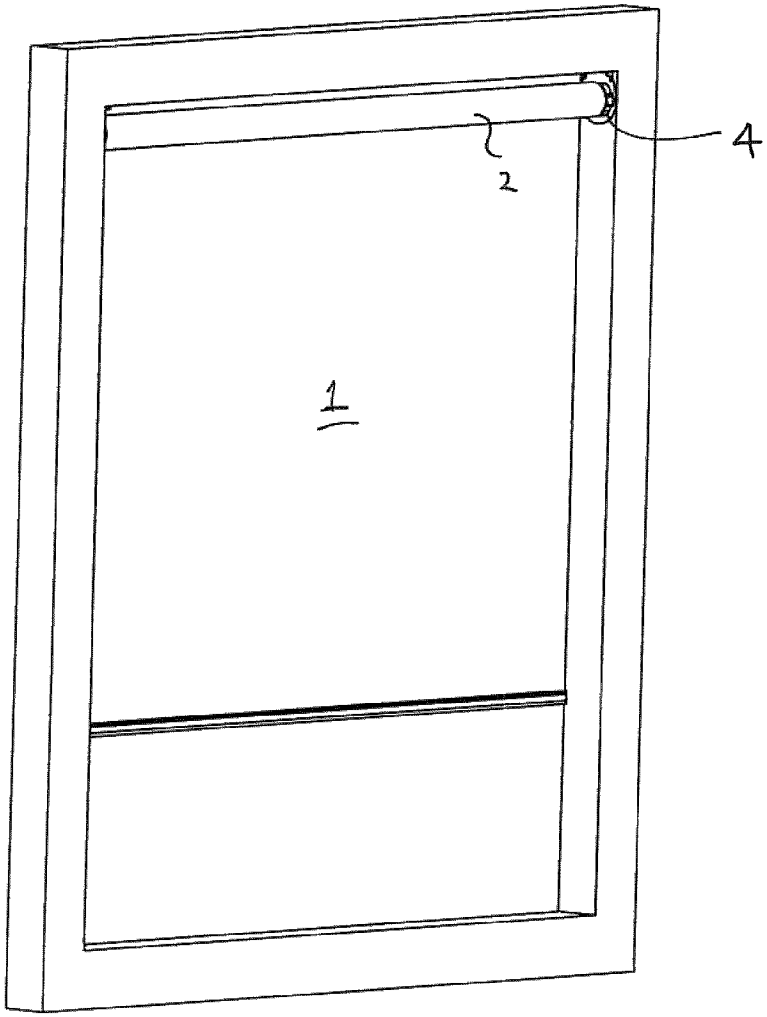
FIG. 1 is a front elevational perspective view of a roller shade or blind mounted within a window frame and employing a pivot mount in accordance with an embodiment of the present invention.
Figure 2:
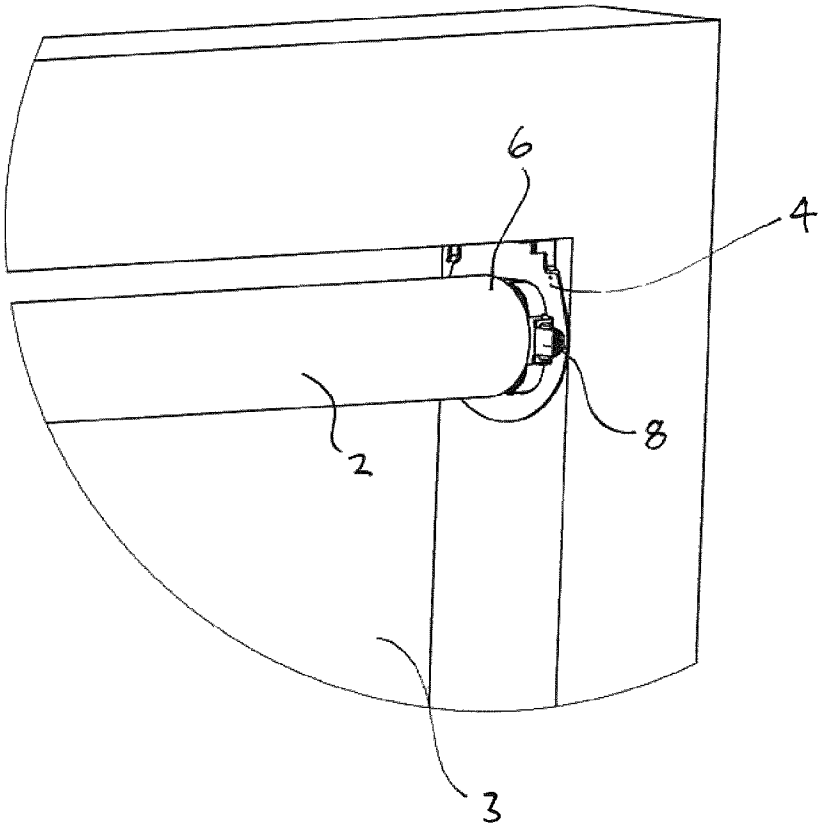
FIG. 2 is a side elevational view of a portion of the roller shade shown in FIG. 1.
Figure 3:
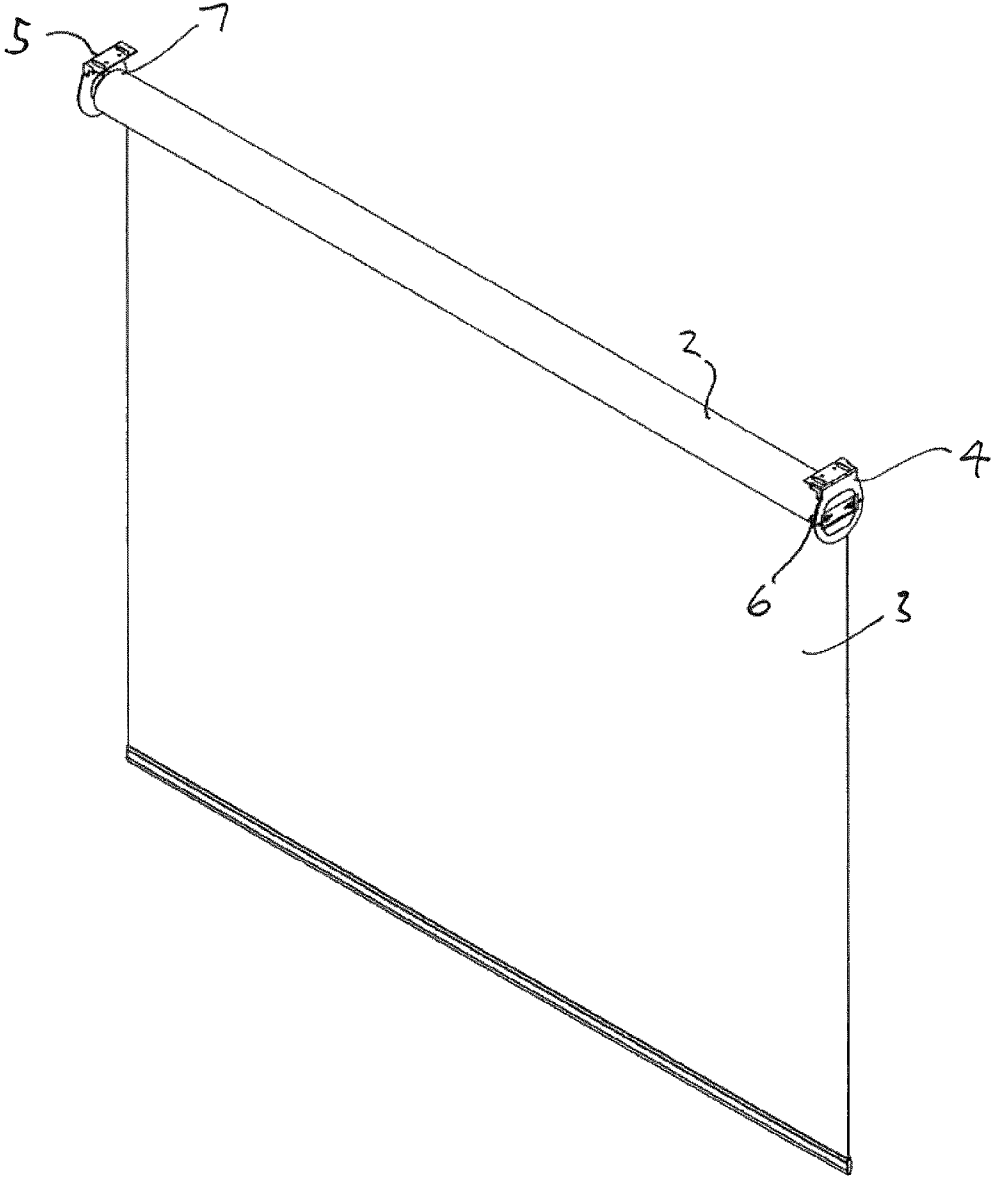
FIG. 3 is a front elevational perspective view of the roller shade of FIG. 1 removed from the window frame.

With reference to the accompanying drawings there are depicted exemplary embodiments of a pivot mount for a roller blind constructed in accordance with the invention. With reference to FIGS. 1-3, there is shown a roller blind 1 that is comprised generally of a roller tube 2 having wound thereon blind fabric 3. The roller tube is releasably securable to a structure (for example a window, wall, ceiling, etc.) between first a end bracket 4 and a second end bracket 5. Roller tube 2 includes a first end 6 which may be referred to as the drive end that cooperates with or is otherwise engaged by some form of drive mechanism that rotates the roller tube to enable the blind fabric to be wound upon the tube or unwound therefrom. First end 6 of the roller tube is releasably securable to first end bracket 4. The opposite or second end 7 of the roller tube is commonly an idler end that is releasably securable to second end bracket 5. Second end 7 of the roller tube commonly includes a pin or other axle-type structure that permits the roller tube to freely rotate about its longitudinal axis relative to end bracket 5.

In accordance with the invention, there is provided a pivot mount 8 for hanging first end 6 of roller tube 2 from first end bracket 4. Pivot mount 8 is comprised generally of at least one yoke 9 and an axle member 10. It is expected that is most instances two yokes will be utilized. Yokes 9 are secured to first end bracket 4 and have generally horizontally oriented throats 11. Axle member 10 is releasably securable to first end 6 of roller tube 2. At least a portion of the axle member is releasably receivable within the throats of yokes 9. With the receipt of at least a portion of the axle member within throats 11, and with the axle member secured to the first end of the roller tube, the first end of the roller tube will effectively be hung from first end bracket 4, while still permitting the roller tube to pivot about the first end bracket in a generally vertical plane (through the rotation of the axle member within throats 11). To help facilitate the rotational movement of the axle member within the throats of yokes 9, the exterior surface of the axle member may be formed so as to cooperatively engage the interior surface of throats 11. In most cases it is expected that the axle member and the throat will be generally circular in diameter or, at least that portion of the axle member and the throats that are engaged and come into contact will have a cooperating curved or generally rounded configuration.

Figure 4:
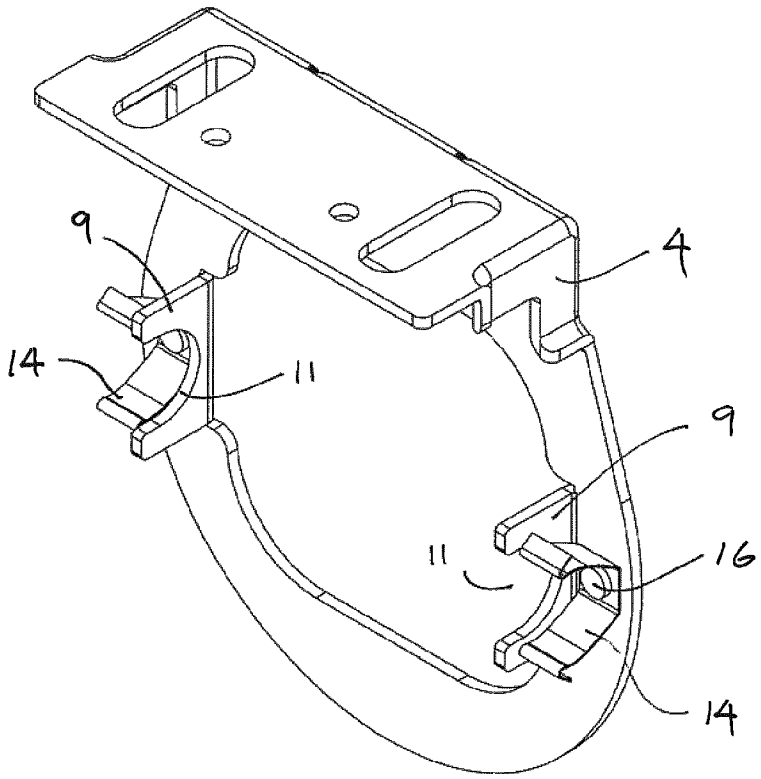
FIG. 4 is an upper side perspective view of an end bracket of the roller blind of FIG. 1 incorporating a pivot mount.
Figure 5:
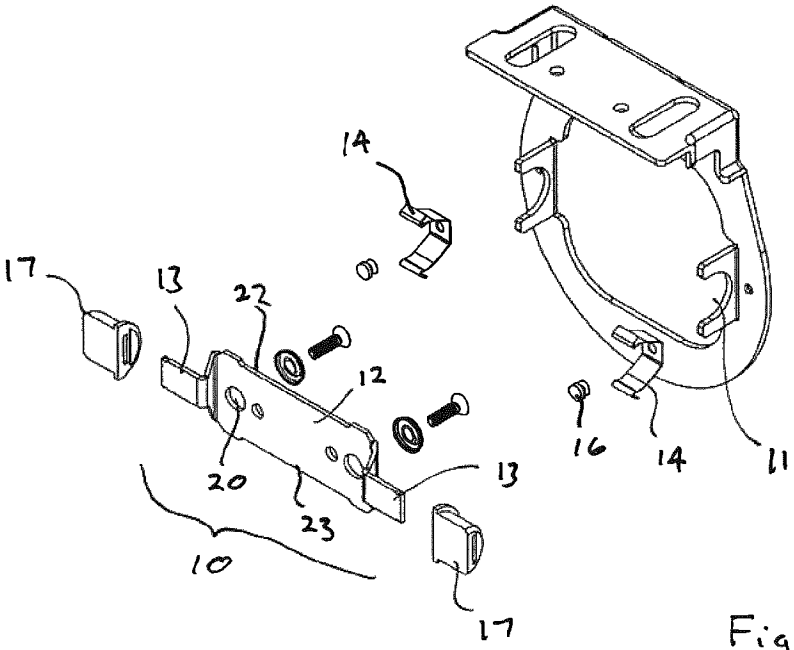
FIG. 5 is an exploded view of the end bracket of FIG. 4 together with a related axle member securable to an end of the roller tube.
Figure 6:
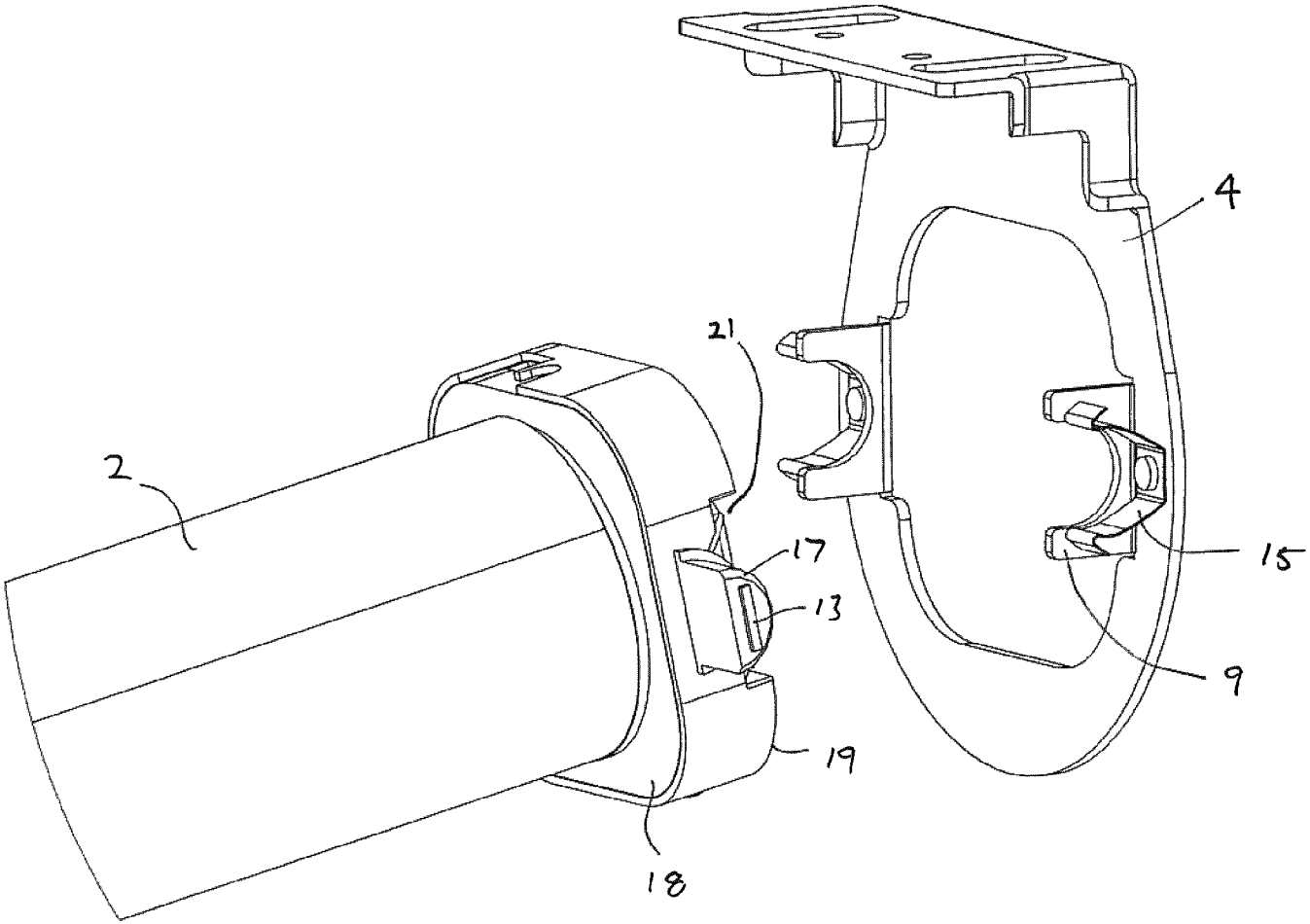
FIG. 6 is a partial assembly view showing the roller tube immediately prior to engagement with the pivot mount.
Figure 7:
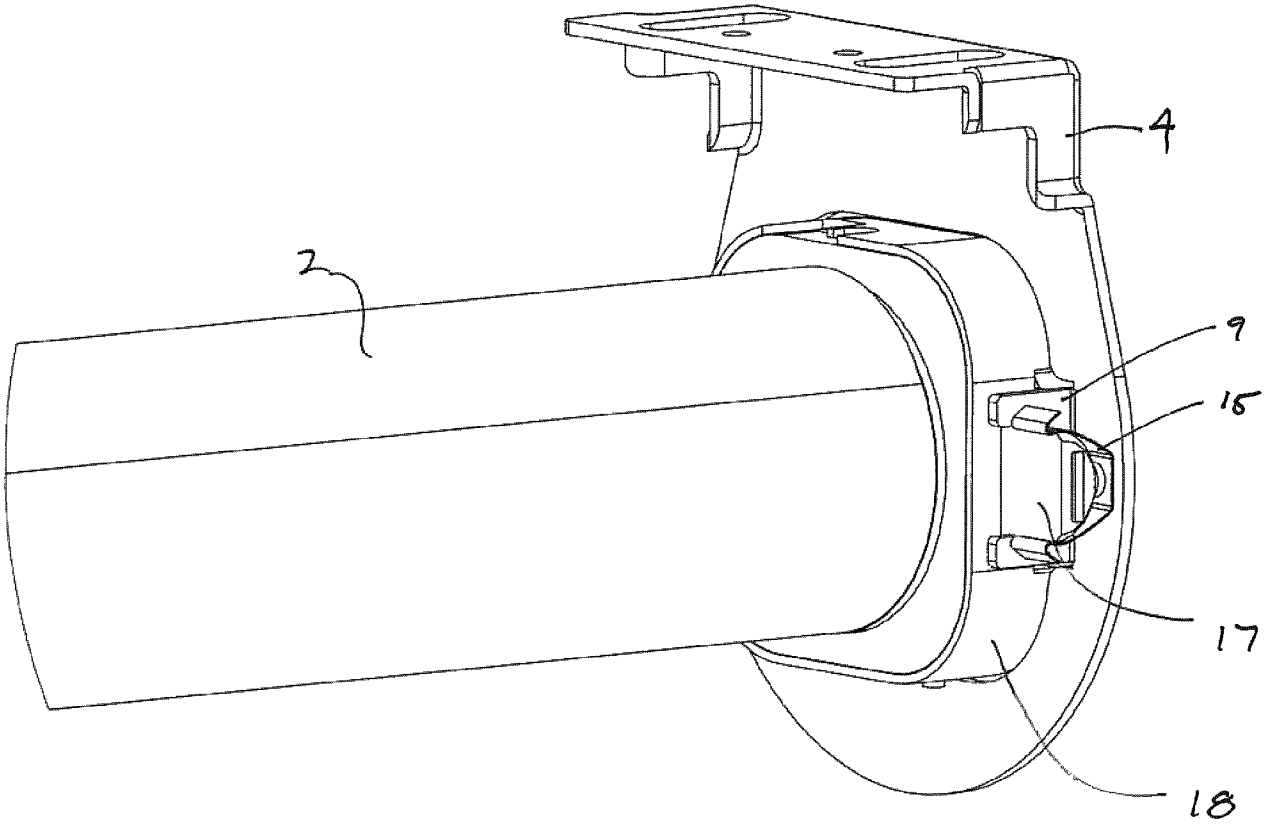
FIG. 7 is a view subsequent to FIG. 6 wherein the roller tube has engaged the pivot mount.

In the embodiment of the invention shown in FIGS. 4 and 5, axle member 10 comprises a roller tube bracket 12 having two spindles 13 extending from opposite sides. In this embodiment, the pivot mount includes a pair of yokes 9 spaced apart along a generally horizontal plane on first end bracket 4. One of each of the spindles 13 is releasably receivable within the throat of one of the yokes 9. With the yokes positioned in a generally horizontal plane, the receipt of the spindles within the yokes will permit pivotal movement of the axle member (and hence the roller tube) in a generally vertical plane.

The pivot mount may also include one or more retainers 14 to help releasably secure axle member 10/spindles 13 within throat 11. It will be appreciated that a wide variety of different retainers (including but not limited to pins, spring clips cotter keys, etc) could be utilized while remaining within the broad scope of the invention. In the case of the embodiment shown in FIGS. 4 and 5, retainers 14 comprise a pair of U-shaped spring clips 15, one associated with each of yokes 9, to releasably secure a spindle in each of the throats of the yokes. Here, the spring clips are secured to first end bracket 4 using a fastener 16. The spring clips are positioned such that they will be received about the surface of the spindles when the spindles are inserted into the throats of yokes 9. The spring clips are formed to apply a biasing force about the exterior surface of the spindles to assist in retaining the spindles within throats 11.

It will be appreciated by those of skill in the art from an understanding of the invention that for manufacturing and cost reduction purposes, axle member 10 may be in the form of a stamped part of relatively thin thickness. Alternately, the axle member could also be cast, extruded, moulded or otherwise formed such that it has a relatively thin thickness. It will further be appreciated that minimizing the thickness of the axle member will help to retain the end of the roller tube in close proximity to the window frame, and thereby help to limit the intrusion of light between the window frame and the side surface of the blind fabric. In cases where axle member 10 is formed from material having a relatively thin thickness, spindles 13 may be of a thickness that is not conducive to pivotal movement within throats 11 of yokes 9. In such instances the spindles may include isolation bearings 17 that serve the dual function of presenting an exterior surface that is more compatible to rotational engagement with the yokes, and that also may be of a "softer", or potentially compressible, material, to help accommodate vibration between the axle member and the yoke. In an alternate embodiment (not shown) spindles 13 may be of a generally circular diameter, however, it may still be desirable to incorporate the use of isolation bearings in order to accommodate vibration and reduce noise. In a further embodiment (see FIGS. 8-10), isolation bearings 17 may be more of an elliptical (or elongated, as opposed to circular) shape in order to concentrate the load transferred from the axle member to the yokes in a generally vertical plane.

With reference to FIG. 5, in one embodiment of the invention spindles 13 are off-set from roller tube bracket 12. As shown, the spindles are off-set from the roller tube bracket in a direction that is laterally away from first end bracket 4 when the blind is assembled. In this embodiment the first end bracket preferably includes a centrally located opening that is larger than the outside diameter of first end 6 of the roller tube. It will thus be appreciated that with roller tube bracket 12 secured to first end 6 of roller tube 2, the off-set nature of the spindles will allow the end of the roller tube to sit further within the end bracket and in closer proximity to the wall of the window frame when the spindles are received within throats 11, than would be the case if the spindles were not off-set. Positioning the end of the roller tube in close proximity to the wall of the window frame helps to limit the degree of light intrusion between blind and the window frame.

It is expected that in a number of instances roller blind 1 will include a roller tube motor 18 received within first end 6 of roller tube 2. Motor 18 will provide the means by which the roller tube will be rotated in either direction in order to wind or unwind the blind fabric. In this embodiment, roller tube bracket 13 includes means to secure the bracket to the exposed end 19 of the roller tube motor. A variety of different means could be used to accomplish such a function. In the enclosed drawings the means comprises openings 21 in the roller tube bracket through which screws, bolts or other fasteners can be inserted in order to secure the bracket to the exposed end of the motor.

The exposed end of the motor may include a generally horizontally oriented slot 21 for receiving roller tube bracket 12, which would be of a cooperating size and shape. With the roller tube bracket received within slot 21, it will be understood that its upper and lower longitudinal edges (22 and 23 respectively) will act as torque receiving surfaces that engage the side walls of slot 21 and that effectively prevent rotation of end 19 of the motor when the spindles are received within throats 11. That is, when the motor is activated it is necessary to secure end 19 to prevent its rotational movement, thereby permitting the motor to rotate the roller tube in one direction or the other. The torque of the motor will thus be received upon either upper edge 22 and/or lower edge 23, transferred from the roller tube bracket to spindles 13, and from there transferred from the spindles through yokes 9 to first end bracket 4.

Figure 8:
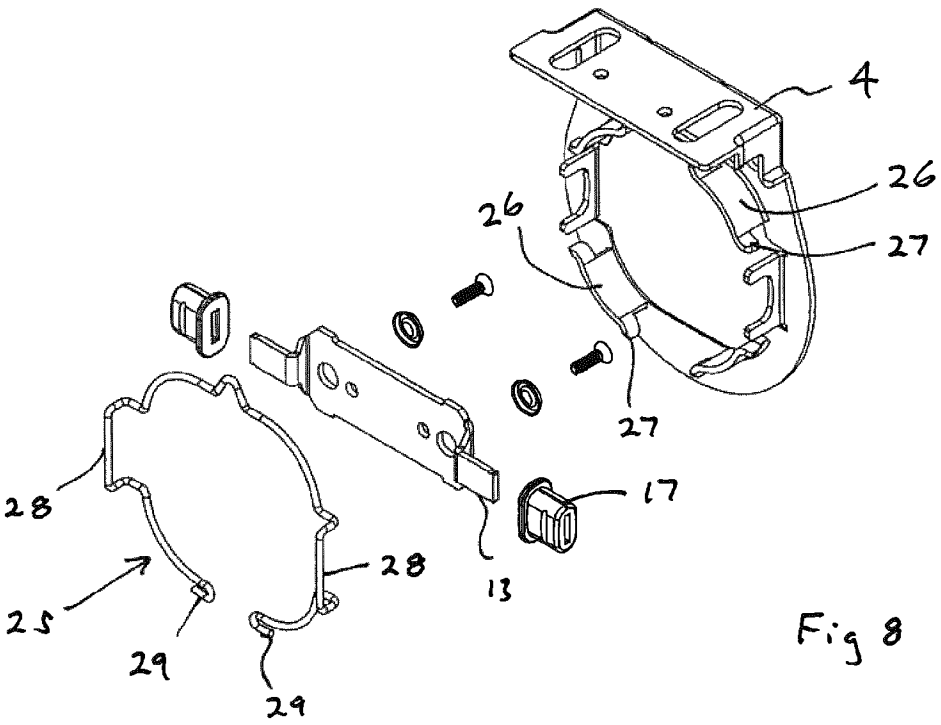
FIG. 8 is an exploded view of an alternate embodiment of the end bracket of FIG. 4, together with a related axle member securable to an end of the roller tube.
Figure 9:
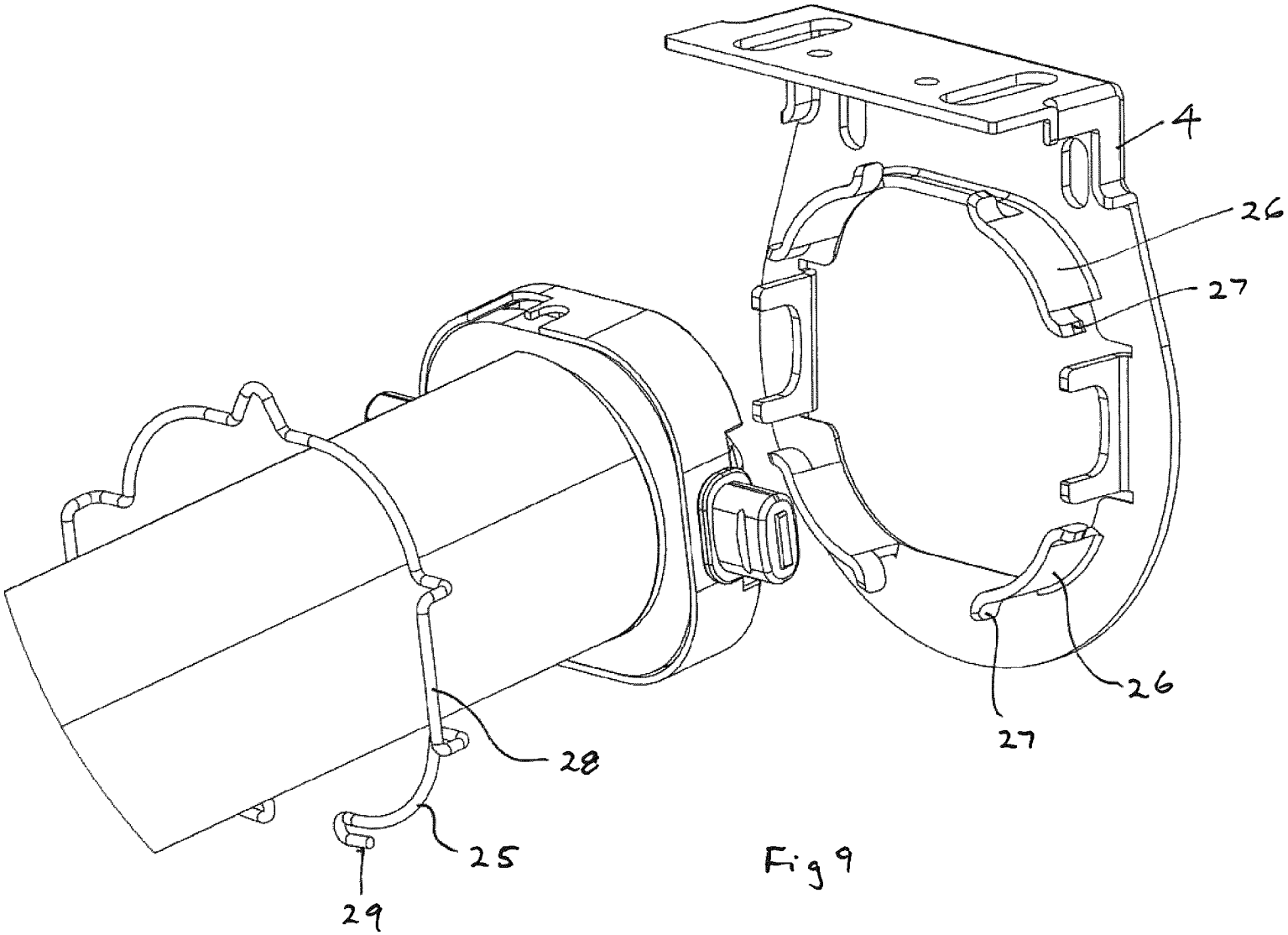
FIG. 9 is a partial assembly view showing the roller tube immediately prior to engagement with the end bracket of FIG. 8.
Figure 10:
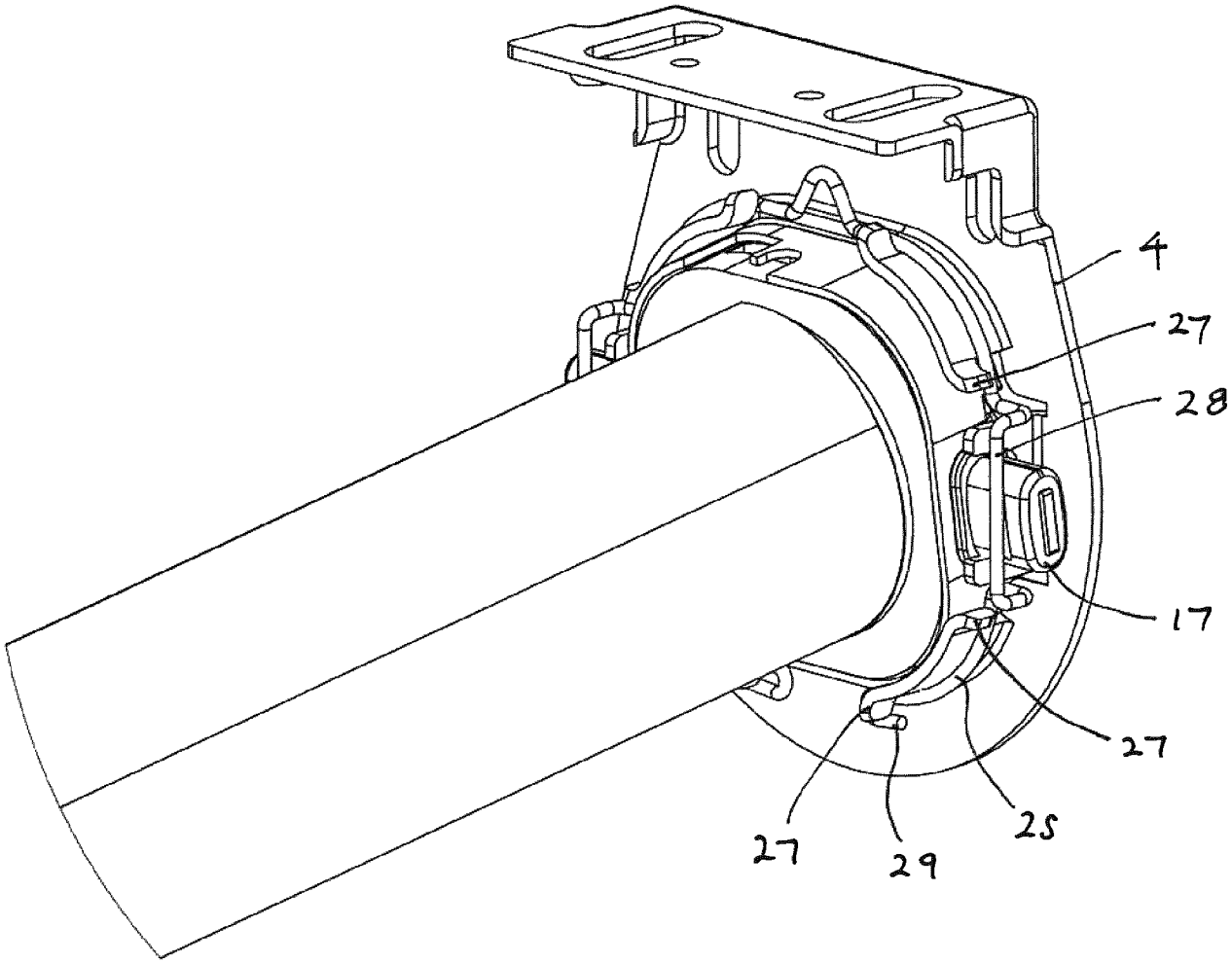
FIG. 10 is a view subsequent to FIG. 9 wherein the roller tube has been fully engaged with the end bracket.
Figure 11:
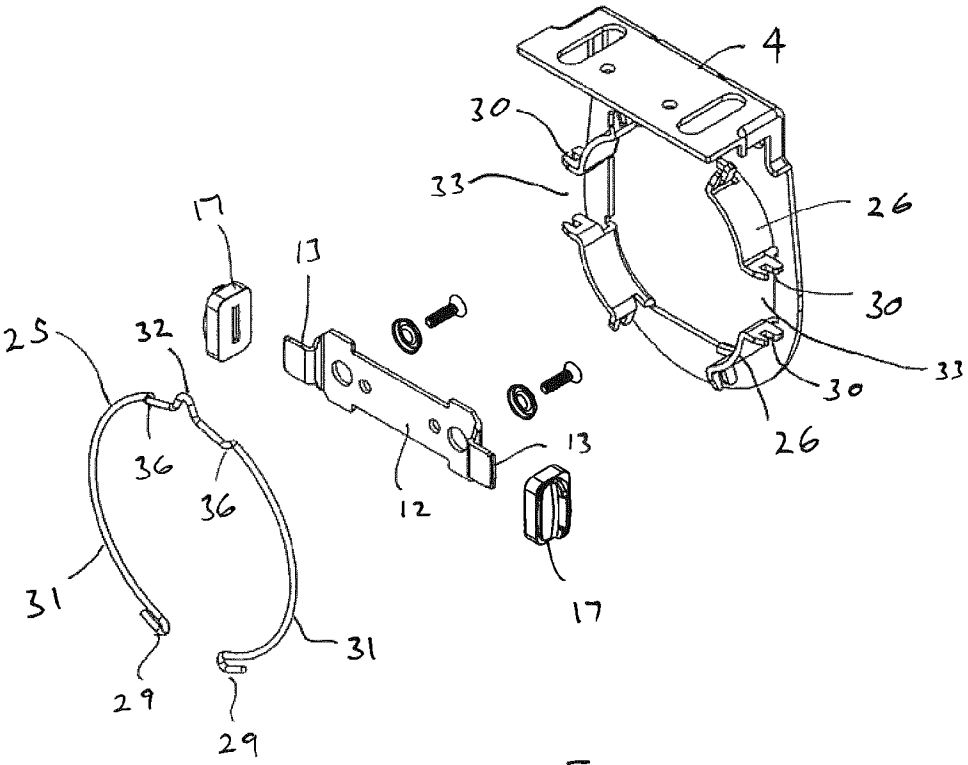
FIG. 11 is an exploded view of an alternate embodiment of the end bracket shown in FIG. 8.
Figure 12:
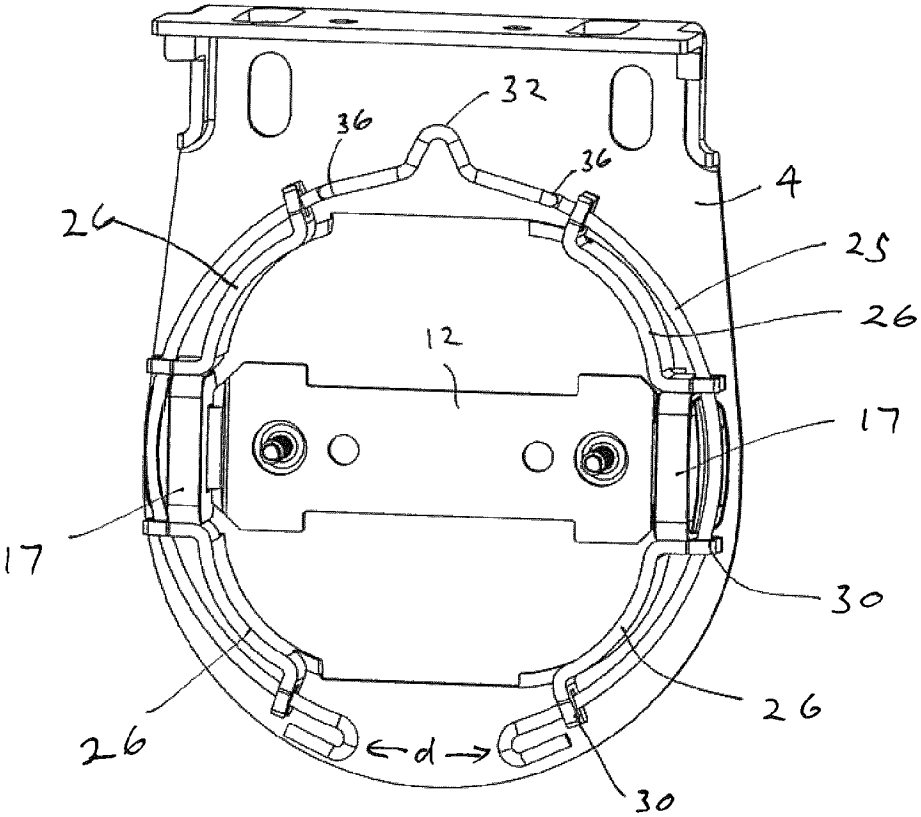
FIG. 12 is a left side view of the end bracket of FIG. 8 in an assembled form, having nothing secured to its roller tube bracket.

FIGS. 8 through 10 show an alternate embodiment. Here, rather than utilizing a pair of retainers 14, a single retainer in the form of a generally circular spring clip 25 is used to help retain the spindles within the throats of yokes 9. In this embodiment first end bracket 4 includes a series of flanges 26 extending outwardly from its surface at approximately 90 degrees and generally parallel to the longitudinal axis of the roller tube. Flanges 26 have hook-like members 27 which retain spring clip 25 circumferentially about the flanges when the spring clip engages end bracket 4. Spring clip 25 includes a pair of engagement portions 28 which are received about spindles 13 when the spindles are located within the yokes. As shown particularly in FIG. 10, when spring clip 25 is engaged about flanges 26 and secured in place on end bracket 4 by hooks 27, engagement portions 28 will retain spindles 13 within the throats 11 of yokes 9 and will restrict the withdrawal of the end of the roller tube from the first end bracket. Spring clip 25 may be a discontinuous, generally circular shaped, structure having a pair of loops 29 at its opposite ends that engage side surfaces of flanges 26 to lock the spring clip about the flanges and in position upon first end bracket 4.

When assembling the roller shade the spring clip is first received over roller tube 2 (see FIG. 9). The end of the roller tube is then placed adjacent to first end bracket 4 so that spindles 13 are received within yokes 11. The roller tube can then be lifted into a generally horizontal position, permitting spring clip 25 to be slid longitudinally along the roller tube. When the spring clip is pushed up against flanges 26 the clip is "snapped" into place behind hook-like members 27 and with loops 29 received about the side surface of two of the flanges, thereby holding the spring clip in place. Engagement portions 28 will at that point be received about the rearward surfaces of spindles 13, retaining the spindles within throats 11 of yokes 9 (see FIG. 10).

The above described pivot mount will thus help facilitate the installation of a roller blind. The installer will first secure the two end brackets to the window frame, a wall, ceiling or other structure. The first end 6 of the roller tube (which includes the drive mechanism) will then be lifted so that spindles 13 can be received within the throats of 11 of yokes 9. At that point the first end of the roller tube will be effectively hung from first end bracket 4. The installer then only need to pivot the roller tube about its first end by lifting second end 7 vertically until the second end is aligned with second end bracket 5 and can be secured thereto. The pivot mount assists in the installation of the roller tube, particularly where the tube is of an extended length or significant weight (such as where the tube includes an electric motor). Removing the roller tube for service is equally simple as the installer need only release the second end 7 from second end bracket 5, pivot the roller tube about the first end bracket 4 by lowering second end 7 vertically downward, and then release spindles 13 from yokes 9.

FIGS. 11 through 17 show yet a further alternate embodiment. Here, as in the case of the embodiments shown in FIGS. 8 through 10, a single retainer in the form of a generally circular spring clip 25 is used to help retain or secure spindles 13 to bracket 4. Also as in the case of the previously described embodiment, first end bracket 4 includes a series of flanges 26 extending outwardly from its surface at approximately 90° and generally parallel to the longitudinal axis of the roller tube. In the embodiment shown, four such flanges are utilized. One point of distinction between the embodiment of FIGS. 11 through 17 and that of FIGS. 8 through 10 is that the hook-like members 27 on each end of the flanges 26 are forked and comprise spring clip holders 30. Spring clip 25 is received about the exterior of flanges 26 and within forked spring clip holders 30 such that the spring clip is releasably secured to the flanges and hence first end bracket 4.

In the particular embodiment shown in FIGS. 11 through 17, spring clip 25 is formed from a flexibly resilient material and is generally circular with two symmetrical sides or legs 31 that meet at an arched apex 32. When assembled upon end bracket 4, spring clip 25 is oriented with arched apex 32 positioned at the top of the end bracket. The lower ends of each of legs 31 may include loops or looped portions 29 that are spaced apart from one another by distance "d" shown in FIG. 12.

Figure 13:
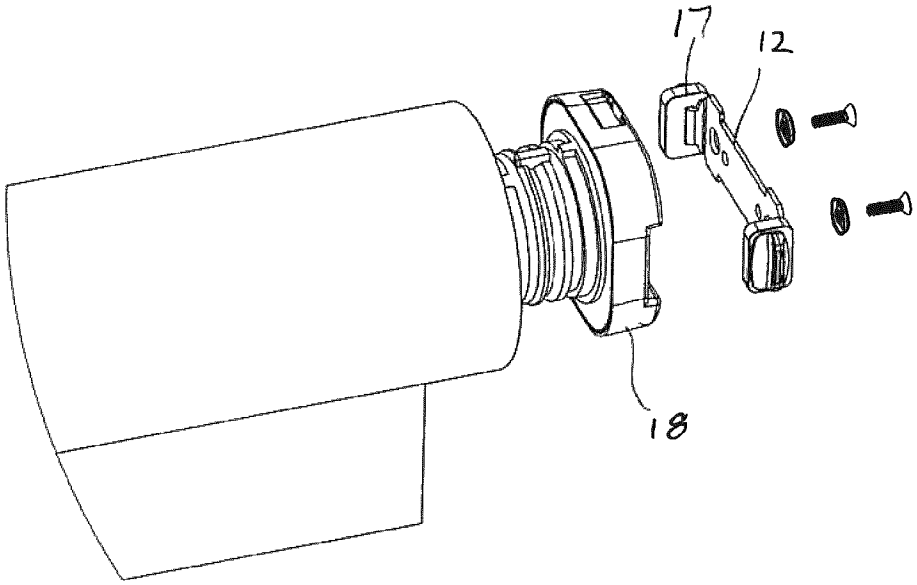
FIG. 13 is a side perspective view of the roller tube bracket of FIG. 11 immediately prior to securing to a motor fixed to a roller tube.
Figure 14:
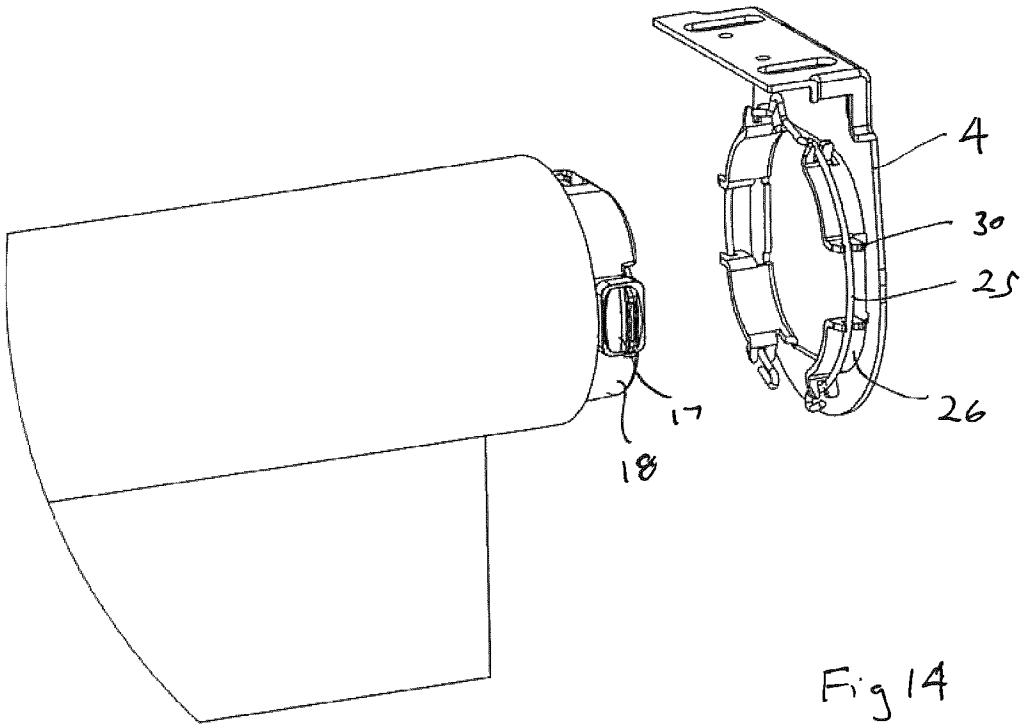
FIG. 14 is a partial assembly view of the embodiment of FIG. 11 showing the motor immediately prior to engagement with the end bracket.
Figure 15:
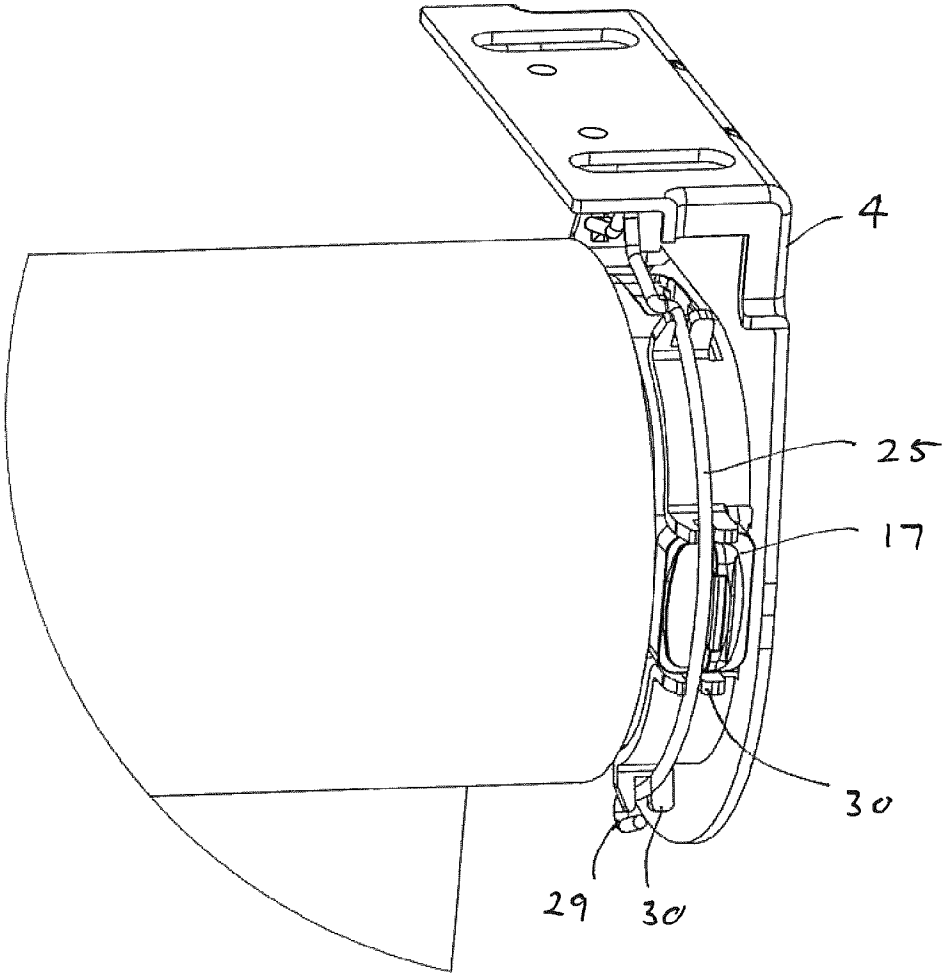
FIG. 15 is a view subsequent to FIG. 14 wherein the motor, and the roller tube attached thereto, have engaged the end bracket.
Figure 16:
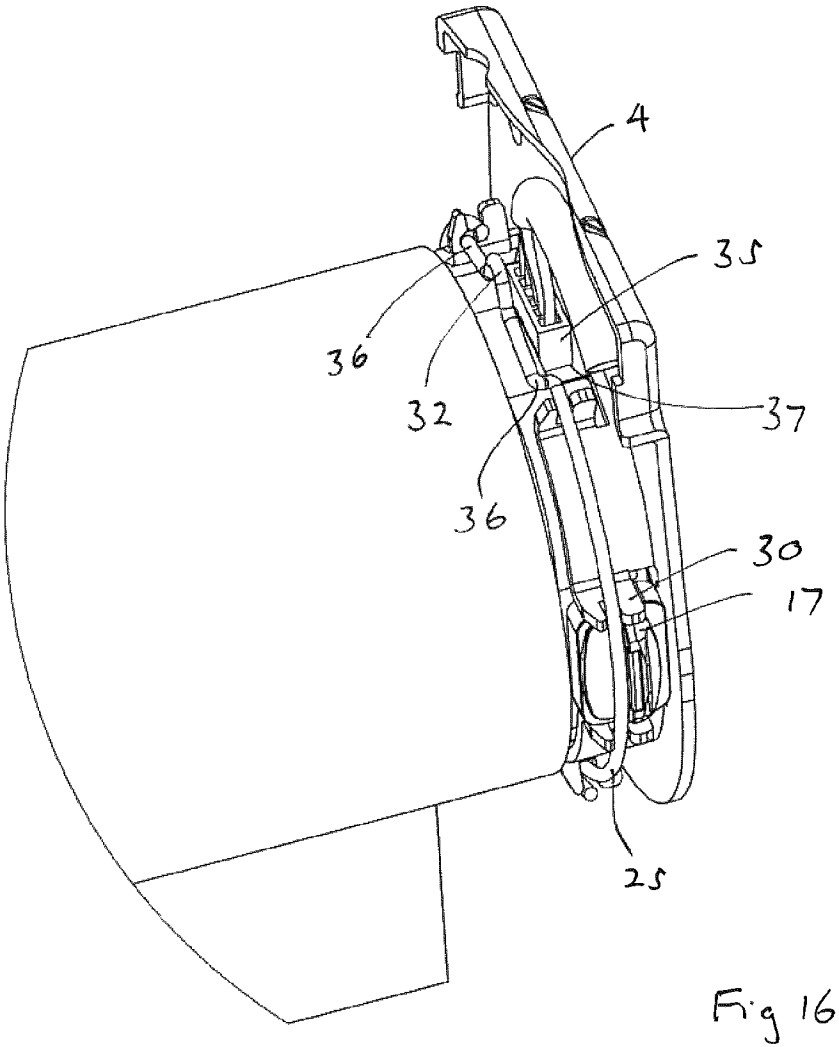
FIG. 16 is a view similar to Figure showing the motor electrical connections.
Figure 17:
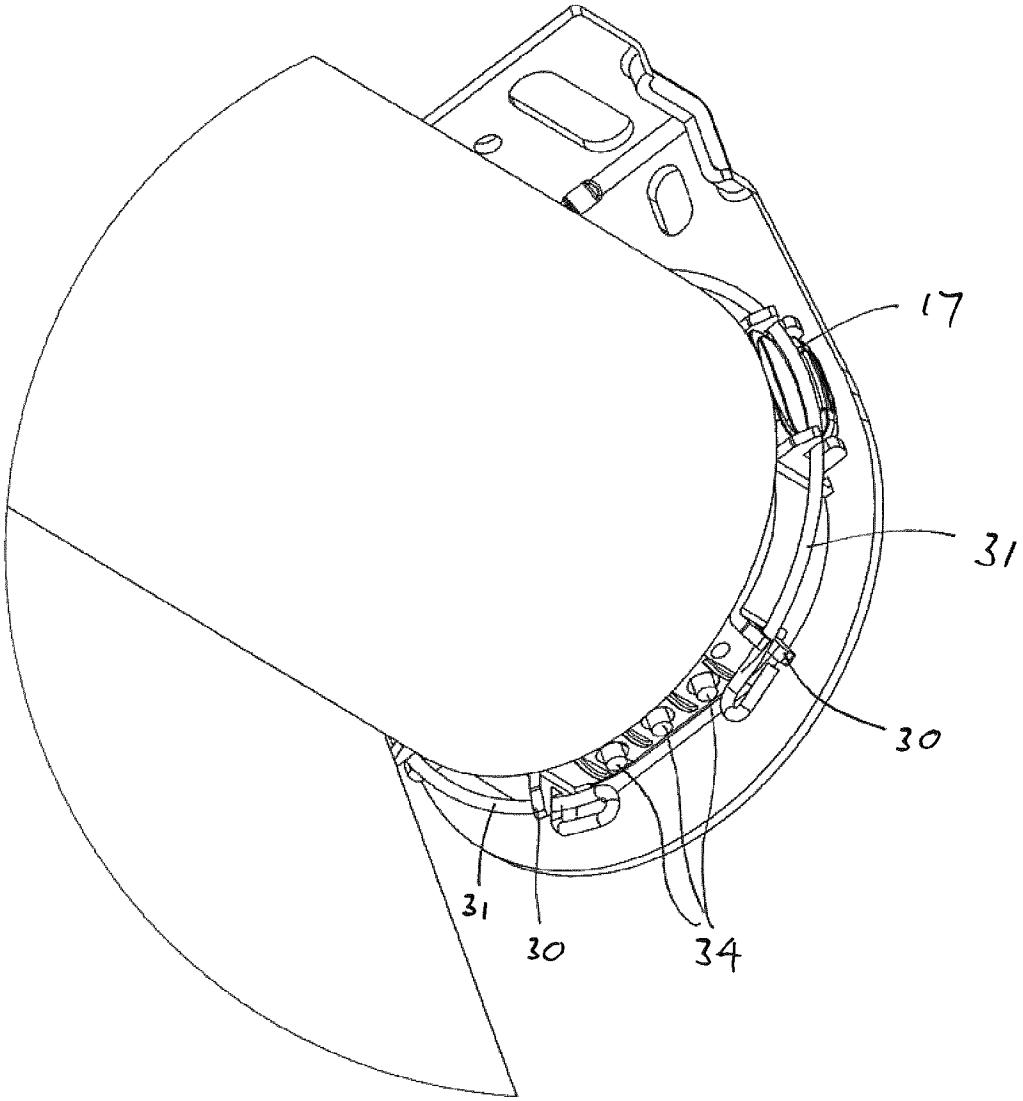
FIG. 17 is a lower perspective view of FIG. 16 showing the motor control switches.

In the embodiment of FIGS. 11 through 17, flanges 26 will be spaced apart in a manner to present a pair of diametrically opposed openings 33 for the receipt of spindles 13 and bearings 17 therebetween in order to secure the roller tube to the end bracket. With specific reference to FIGS. 13 through 15, the manner in which a roller tube (in this instance having secured thereto a motor 18) may be releasably secured to first end bracket 4 will now be described in greater detail. First, as generally indicated in FIG. 13, roller tube bracket 12 is secured to the end of motor 18. Thereafter, the motor (mounted within a roller tube) will be aligned with opening 33 between flanges 26 and first end bracket 4, as shown more specifically in FIG. 14.

The roller tube and motor are then brought into contact with first end bracket 4 such that the leading surfaces of bearings 17 come into contact with spring clip 25 adjacent to openings 33. The leading edges of bearing 17 are preferably champered or sloped such that as the motor/roller tube assembly is pushed further toward first end bracket 4 the bearings apply a force to the spring clip causing legs 31 to be displaced outwardly, permitting bearings 17 to be received fully within openings 33. As the trailing edge of the bearings pass by spring clip 25 the legs of the spring clip are no longer displaced outwardly and "snap" back into position (received within forked spring clip holders 30) to thereby secure bearings 17 within openings 33. Securing the motor/roller tube assembly to the end bracket thus merely requires pushing the end of the motor or the roller tube into the end bracket in order to, first displace the spring clip sufficiently to allow the bearings to be received within openings 33, after which legs 31 of the spring clip snap back into position and lock the motor/roller tube assembly in place. It will be appreciated by one of ordinary skill in the art that such a structure permits an installer to easily and simply secure the end of a roller tube (with or without a motor) to first end bracket 4 without the use of tools and in an efficient and effective manner. Removing the roller tube (or motor) for service simply requires the installer to displace legs 31 of the spring clip outwardly to permit bearings 17 to be withdrawn from openings 33.

The embodiment of FIGS. 11 through 17 provides a further advantage in situations where the end of the roller tube is fitted with a motor 18. Such motors commonly include a plurality of control switches 34 along their lower circumferential surface. In addition, the motors will in many instances have an electrical connector 35 that is secured to the motor along the upper or top circumferential surface. To accommodate electrical connector 35, spring clip 25 preferably includes a pair of off-sets 36 that displaces arched apex 32 and a portion of the spring clip on either side of the apex longitudinally away from first end bracket 4. The outwardly displaced portion of the spring clip, together with upper ends of flanges 26, define an opening 37 through which the electrical connector 35 may be received. Further, offsets 36 each engage a respective one of the forked spring clip holders on a separate flange 26 to prohibit or limit rotation of the spring clip about the exterior surfaces of the flanges. In this manner, the spring clip will be held in a position such that the looped ends 29 of legs 31 will remain positioned to enable an installer to readily access switches 34. It will be appreciated that should the spring clip be allowed to rotate, a portion of one of the legs 31 may interfere with accessing one or more of switches 34. It will also be appreciated that spring clip 25 and flanges 26 could be designed such that the relative positioning of the electrical connector and the opening to access the switches may be located at various other positions about end bracket 4 if desired. In addition, loops 29 on the ends of the spring clip may be reduced in size to permit greater access to switches 34.

It is to be understood that what has been described are the preferred embodiments of the invention. The scope of the claims should not be limited by the preferred embodiments set forth above, but should be given the broadest interpretation consistent with the description as a whole.

We claim:

1. A roller blind, the roller blind having a roller tube with first and second ends that are releasably securable to first and second end brackets, the roller blind having a roller tube motor secured to the first end of the roller tube with an end of the motor exposed, the roller tube motor including an electrical connector, the roller blind further including a mount comprising:

a spring clip releasably securable to the first end bracket, said spring clip being off-set from the first end bracket adjacent to the electrical connector to prevent interference between the electrical connector and said spring clip, and an axle member releasably securable to the exposed end of the roller tube motor, said axle member comprising a roller tube bracket having a pair of spindles extending from opposite sides thereof, said spindles including a leading edge for contacting the spring clip when said spindles are moved toward said first end bracket, contact of said leading edge of said spindles causing said spring clip to move from a rest position to a displaced position, when in said displaced position said spring clip permitting said spindles to be received within openings in the first end bracket such that when positioned within said openings said spindles permit said spring clip to return to said rest position thereby preventing the withdrawal of said spindles from said openings.

2. The roller blind including a mount as claimed in claim 1 wherein said spindles include bearings, said bearings having a leading edge that is sloped or chamfered such that contact between said leading edge of said bearings and said spring clip causes said spring clip to be moved from its rest position to its displaced position.

3. The roller blind including a mount as claimed in claim 2 wherein the first end bracket includes a plurality of flanges, said flanges including spring clip holders that releasably secure said spring clip to the first end bracket.

4. The roller blind including a mount as claimed in claim 3 wherein said spring clip is discontinuous about a circumference of said roller tube motor when said roller tube motor is releasably secured to the first end bracket to permit access to control switches on the circumference of the motor.

5. The roller blind including a mount as claimed in claim 4 wherein said spring clip includes means to prevent rotation of said spring clip about the circumference of the roller tube motor.

* * * * *